US007941889B2

(12) United States Patent
Terao

(10) Patent No.: US 7,941,889 B2
(45) **Date of Patent: *May 17, 2011**

(54) CLEANING TOOL FOR PHOTOGRAPHIC DEVICE

(75) Inventor: Yuji Terao, Saitama (JP)

(73) Assignee: Hoya Corporation, Tokyo (JP)

( * ) Notice: Subject to any disclaimer, the term of this patent is extended or adjusted under 35 U.S.C. 154(b) by 857 days.

This patent is subject to a terminal disclaimer.

(21) Appl. No.: 11/777,626

(22) Filed: Jul. 13, 2007

(65) Prior Publication Data

US 2008/0010764 A1 Jan. 17, 2008

(30) Foreign Application Priority Data

Jul. 14, 2006 (JP) ..... 2006-193953

(51) Int. Cl.
*A47L 25/00* (2006.01)

(52) U.S. Cl. ..... 15/104.002; 15/209.1; 15/210.1; 15/244.1

(58) Field of Classification Search ..... 15/104.002, 15/224.1, 210.1, 209.1
See application file for complete search history.

(56) References Cited

U.S. PATENT DOCUMENTS 2,708,761 A * 5/1955 Bergquist ..... 15/104.002
3,797,875 A * 3/1974 den Hamer ..... 294/1.1
4,085,838 A * 4/1978 Pierce ..... 400/696
6,175,984 B1 * 1/2001 Prime et al. ..... 15/104.002
7,490,380 B2 * 2/2009 Terao ..... 15/104.002

FOREIGN PATENT DOCUMENTS

| | | | |
|---|---|---|---|
| JP | 61-959 | | 1/1986 |
| JP | 6-063183 | U | 6/1994 |
| JP | 3022843 | U | 1/1996 |
| JP | 3042014 | U | 7/1997 |
| JP | 3057656 | | 3/1999 |
| JP | 2005-292404 | | 10/2005 |
| JP | 2005-334525 | | 12/2005 |
| JP | 2005334525 | A * | 12/2005 |
| JP | 2006-000134 | | 1/2006 |
| JP | 2006-006690 | | 1/2006 |

OTHER PUBLICATIONS

U.S. Appl. No. 11/777,590, filed on Jul. 13, 2007, Terao.
Office Action from Japan Patent Office, dated Dec. 14, 2010 (together with an English language translation thereof).

* cited by examiner

*Primary Examiner* — Monica S Carter
*Assistant Examiner* — Stephanie Newton
(74) *Attorney, Agent, or Firm* — Greenblum & Bernstein, P.L.C.

(57) ABSTRACT

A cleaning tool is for removing foreign matter from a surface of a photographic device. The cleaning tool includes an adhesive member and a body. The adhesive member has an adhesive surface for the foreign matter to adhere to. The body has a first end to which the adhesive member is attached, and has an end surface located at a second end being opposite to the first end. The outline of the adhesive surface includes a linear section, and the shape and orientation of the adhesive surface are represented on the end surface.

19 Claims, 18 Drawing Sheets

CLEANING TOOL FOR PHOTOGRAPHIC DEVICE

BACKGROUND OF THE INVENTION

1. Field of the Invention

The present invention relates to a cleaning tool for a photographic device, and especially to a cleaning tool for removing foreign matter attached to a member of a digital camera which has interchangeable lenses or other devices.

2. Description of the Related Art

Recently, the number of digital cameras with interchangeable lenses has been increasing. In an interchangeable lens digital camera, foreign matter such as dust which enters into it when the lens is changed, may become attached to a surface of an imaging device inside the digital camera. In such a case, removing the foreign matter from the surface of the imaging device is required to prevent the deterioration of the image quality due to foreign matter. Further, in photographic devices such as a digital camera, cleaning a view finder, an eyepiece, or so on, is sometimes required.

On the other hand, a cleaning tool that is used for cleaning a precision instrument, an electron device, or so on, and that has an adhesive member used to remove foreign matter from a surface to be cleaned, is already known.

A conventional cleaning tool which uses an adhesive member is not necessarily suited to cleaning a photographic device such as a digital camera. Therefore, such a conventional cleaning tool is not generally suitable for cleaning imaging devices and so on. For example, a cleaning tool which uses an adhesive member having a circular-shaped adhesive surface is not suitable for cleaning rectangular surfaces included in an imaging device, or other devices.

On the other hand, in the case when a cleaning tool is made for cleaning an imaging device or so on, cleaning the view finder, eyepiece, or other devices which have a circular shape differing from that of an imaging device, with such a cleaning tool, is difficult. Especially in a digital single-lens reflex camera, the imaging device is arranged far inside thereof, so that the area of the imaging device to be cleaned cannot be seen by a user; thus the cleaning operation is difficult.

SUMMARY OF THE INVENTION

Therefore, an object of the present invention is to provide a cleaning tool for a photographic device that can remove foreign matter from the surface of an imaging device, or other devices, reliably, and that has superior operationality.

A cleaning tool, according to the present invention, is used to remove foreign matter from a surface of a photographic device. The cleaning tool includes an adhesive member and a body. The adhesive member has an adhesive surface for the foreign matter to adhere to. The body has a first end to which the adhesive member is attached and has an end surface located at a second end, being opposite to the first end. The outline of the adhesive surface includes a linear section, and the shape and orientation of the adhesive surface are represented on the end surface.

The adhesive surface may include an arcuate area of which part of the outline is arcuate, and a rectangular area that has a rectangular shape. The linear section may be coincident with a side of the rectangular area. The arcuate area may have a semicircle shape.

The adhesive surface may be perpendicular to the direction in which the body extends. In the cleaning tool, a part of the outline of the adhesive surface may be a linear section. The adhesive surface may further include an arcuate area of which part of the outline is arcuate.

In the cleaning tool, the end surface may be a similar figure of the shape of the adhesive surface, and the orientation of this figure may be the same as the orientation of the adhesive surface. In the cleaning tool, the body may include a pillar-shaped section whose bottom surface is the end surface.

The cleaning tool may further include a mark that represents the shape and orientation of the adhesive surface, located on the end surface. In the cleaning tool, the adhesive member may have a fitting hole, and the body may have a projection to be fit into the fitting hole, such that the projection may be fit into the fitting hole and the adhesive member may be attached to the body only when the adhesive surface is arranged in the same orientation as represented on the end surface.

BRIEF DESCRIPTION OF THE DRAWINGS

The present invention will be better understood from the description of the preferred embodiments of the invention set forth below together with the accompanying drawings, in which.

DESCRIPTION OF THE PREFERRED EMBODIMENTS

Hereinafter, the preferred embodiments of the present invention are described with reference to the attached drawings.

Figures 1A, 1B:
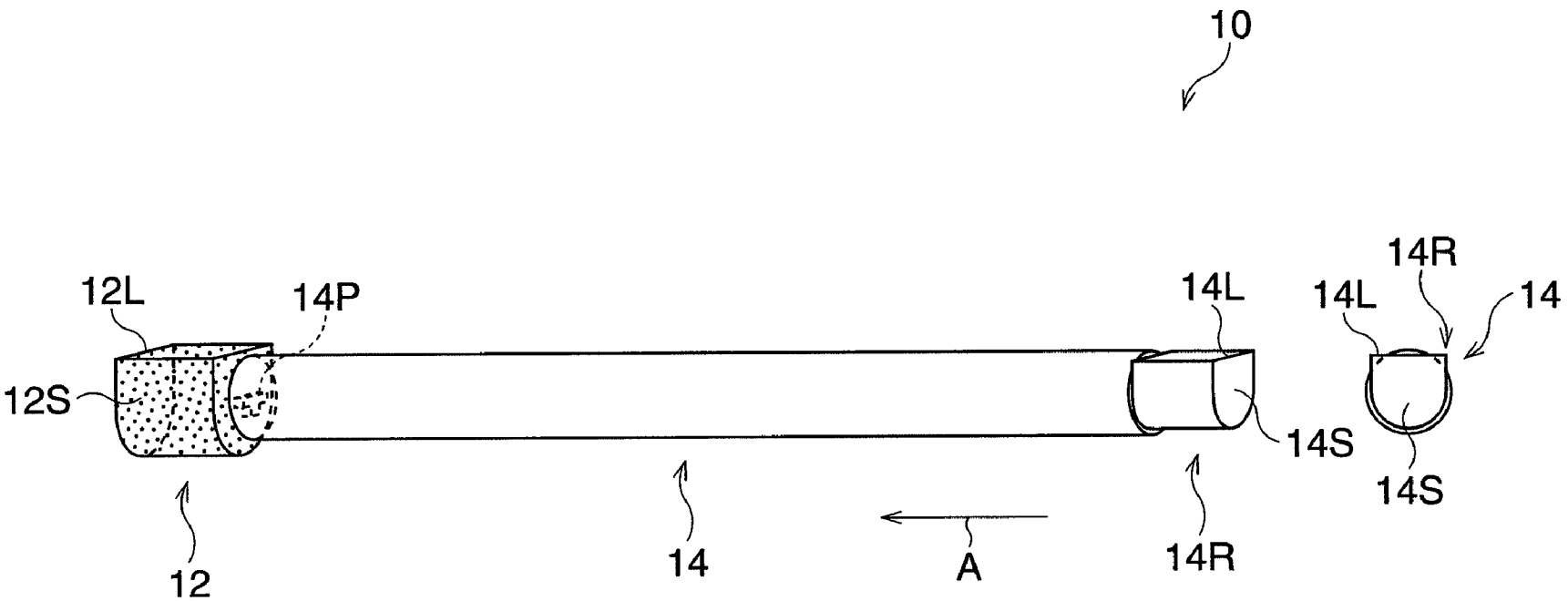
FIG. 1A is a perspective view of the cleaning tool of the first embodiment.
FIG. 1B is a rear view of the cleaning tool of the first embodiment.

A cleaning tool 10 is used for cleaning a surface of a photographic device, that is; a surface of an imaging device, a low-pass filter, a light-receiving surface of a protection filter, a view finder, eyepiece lens or other devices (not shown), by removing foreign matter, such as dust, which is attached to such a surface. In the first embodiment, as represented in FIG. 1A, the cleaning tool 10 includes an adhesive member 12 made of butyl rubber that picks up foreign matter, and a body 14 that has a long, thin cylinder shape and that is formed by resin or other materials. The adhesive member 12 is attached to the front end (first end) of the body 14.

Figure 2:
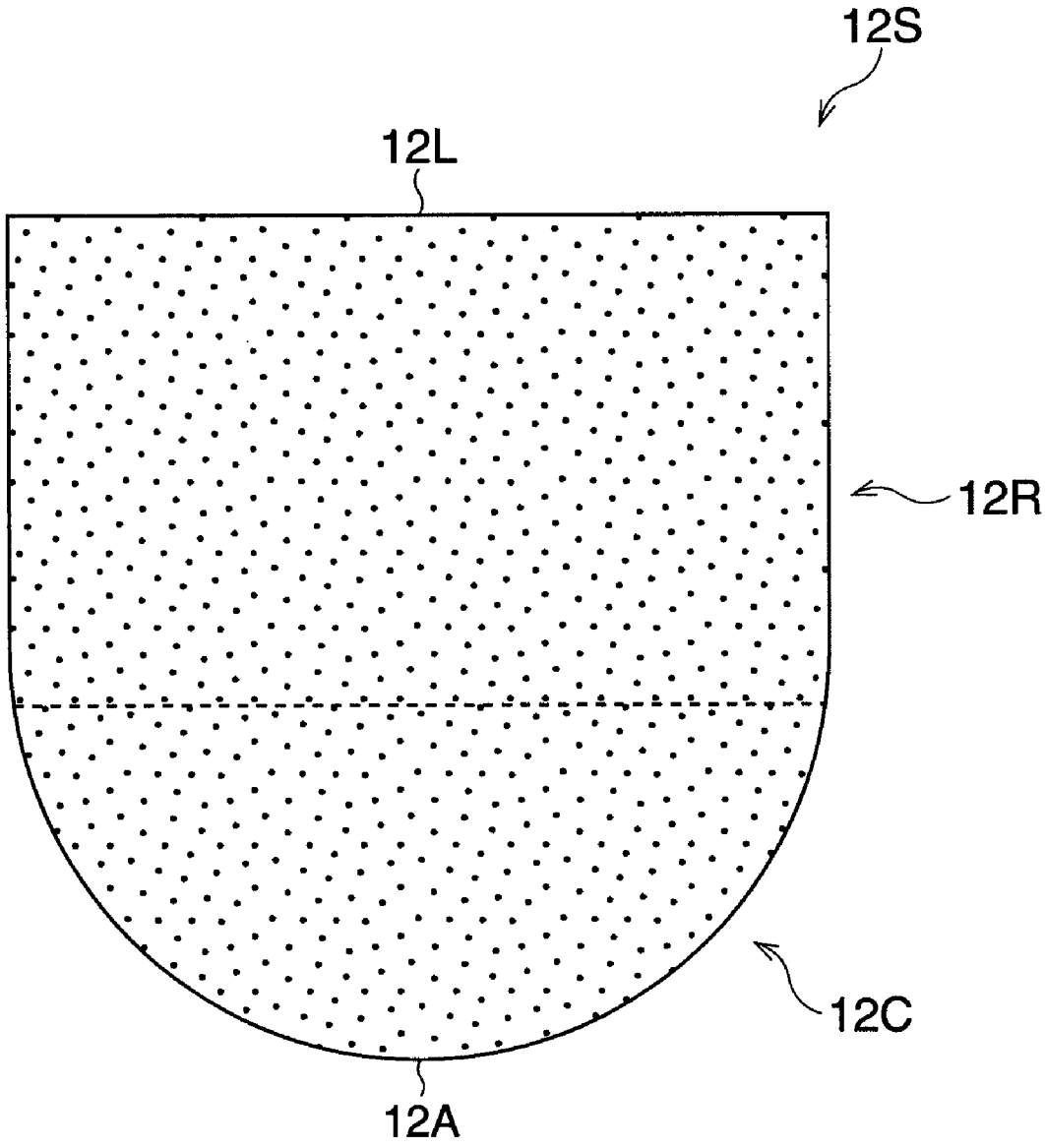
FIG. 2 is a front view of the adhesive surface of the adhesive member of the cleaning tool of the first embodiment.
Figure 3B:
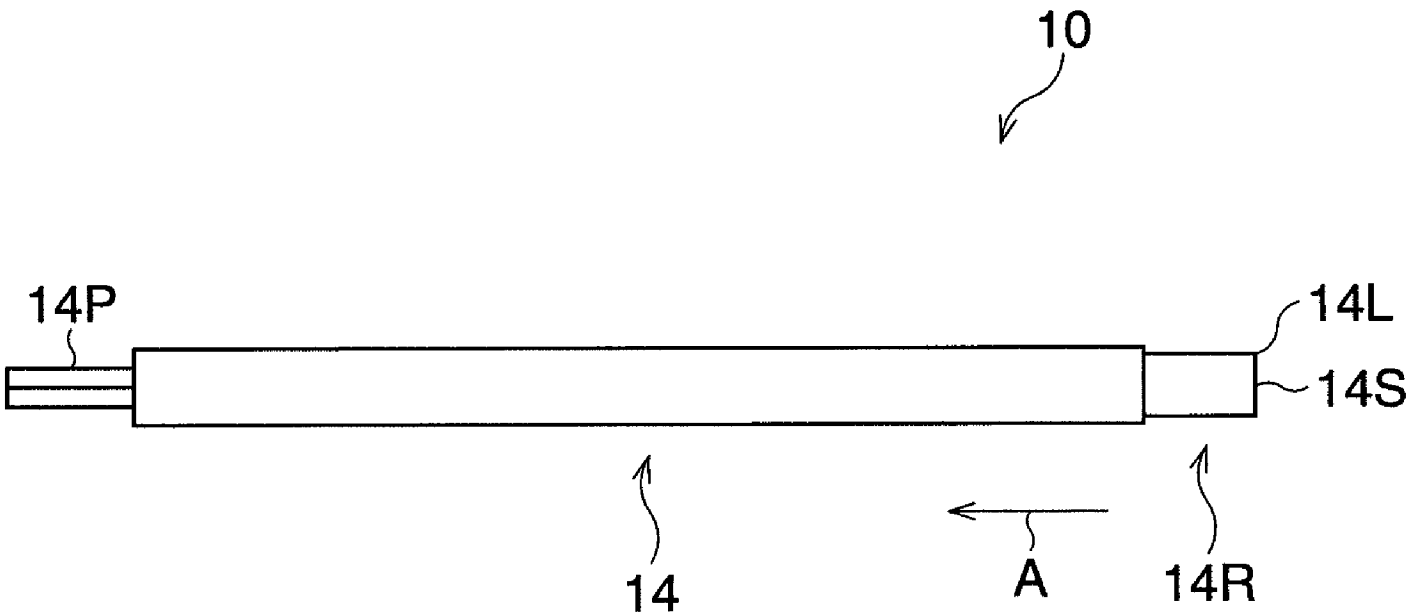
FIG. 3B is a side view of the body of the cleaning tool of the first embodiment, where the adhesive member is detached.

On the surface of the adhesive member 12 facing away from the body 14, an adhesive surface 12S for foreign matter to adhere to, is provided. The adhesive surface 12S is perpendicular to the longitudinal direction in which the body 14 extends, as the arrow A represents (see FIGS. 1A and 3B). As shown in FIG. 2, the adhesive surface 12S includes an arcuate area 12C and a rectangular area 12R. The arcuate area 12C has a semicircle shape, and the outline of the arcuate area 12C includes an arcuate section 12A. The rectangular area 12R adjoins to the arcuate area 12C. On the adhesive surface 12S, a linear section of the outline of the arcuate area 12C, and one of the sides of the rectangular area 12R are coincident to each other, as represented by the broken line in FIG. 2.

As shown in FIGS. 1A and 1B, the rear end (second end) of the body 14, that is, the opposite end of the body 14 to the front end, and the end to which the adhesive surface 12S is not attached, a pillar-shaped section 14R is provided. The pillar-shaped section 14R represents the shape and orientation of the adhesive surface 12S. That is, the end surface of the pillar-shaped section 14R is the rear end surface 14S (end surface), and the shape and orientation of the rear end surface 14S are the same as that of the adhesive surface 12S (see FIG. 1B for a rear view and FIG. 2). Therefore, although the sizes of the rear end surface 14S and the adhesive surface 12S may be different, the rear end surface 14S is a similar figure of the adhesive surface 12S, and a straight line 14L that is a part of the outline of the rear end surface 14S is parallel to a straight line 12L that is a part of the outline of the adhesive surface 12S and that corresponds to the straight line 14L.

As explained above, because the pillar-shaped section 14R, which includes the rear end surface 14S to represent the shape and orientation of the adhesive surface 12S, is provided, the operation of maneuvering the adhesive surface 12S to a position suitable for cleaning a surface to be cleaned, with a suitable orientation, becomes easy.

Figure 3A:
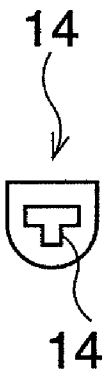
FIG. 3A is a front view of the body of the cleaning tool of the first embodiment, where the adhesive member is detached.
Figure 4B:
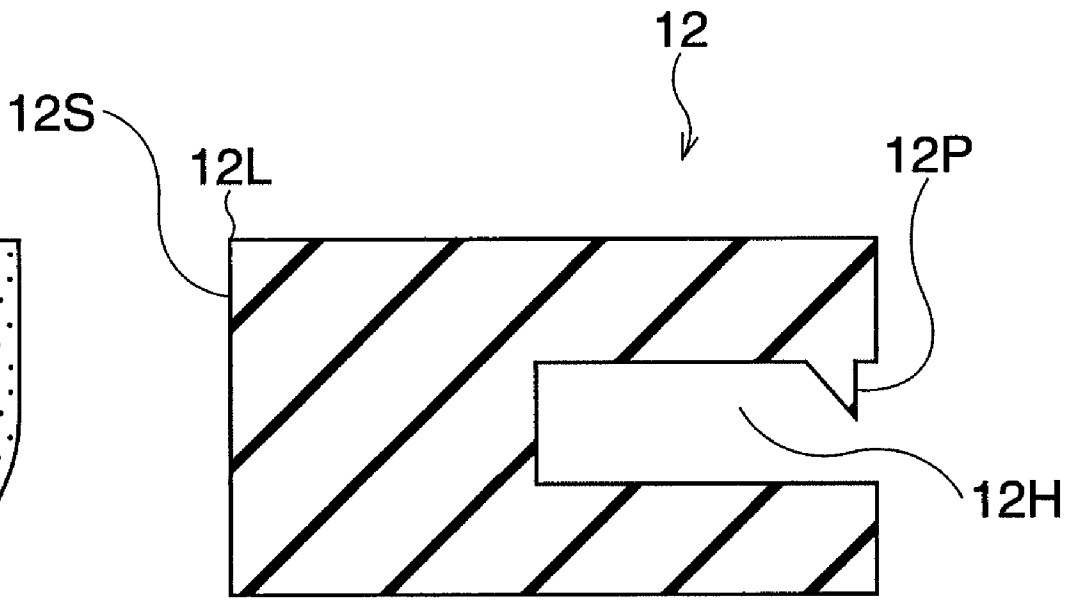
FIG. 4B is a sectional view of the adhesive member of the first embodiment.
Figure 4A:
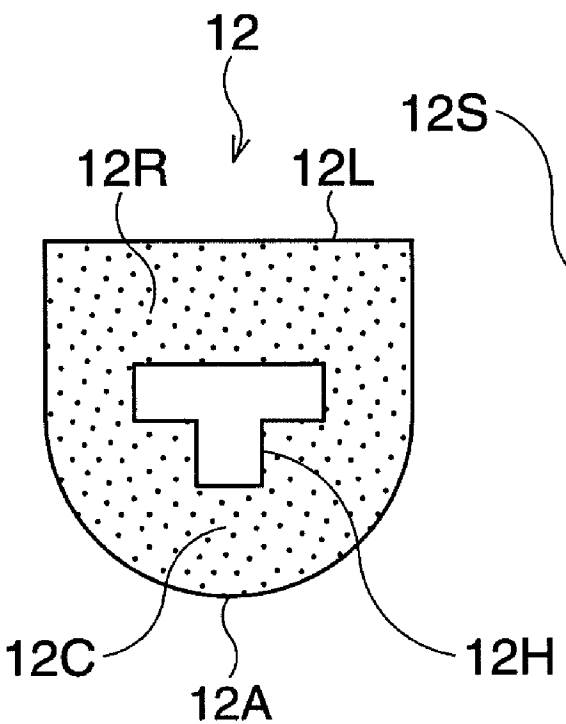
FIG. 4A is a rear view of the adhesive member of the first embodiment.

The adhesive member 12 has a fitting hole 12H (see FIGS. 4A for a front view and 4B for a section view). At the front end of the body 14, a body-side-projection 14P (a projection) to be fit into the fitting hole 12H is provided (see FIGS. 3A for a front view and 3B for a side view). As is clear from these figures, both of the sections of the fitting hole 12H and body-side-projection 14P, taken along a direction that is perpendicular to the longitudinal direction of the body 14 represented by the arrow A, have a T-shape.

As explained above, the fitting hole 12H and the body-side-projection 14P have shapes so that the body-side-projection 14P can be fit into the fitting hole 12H and the adhesive member 12 can be attached to the body 14 only when the adhesive member 12 is oriented in the proper orientation, that is, when the adhesive surface 12S is oriented in the same orientation as represented on the rear end surface 14S. Further, because both sectional shapes of the fitting hole 12H and the body-side-projection 14P have a T-shape, the adhesive member 12 is prevented from rotating around the direction in which the body 14 extends.

Figure 5:
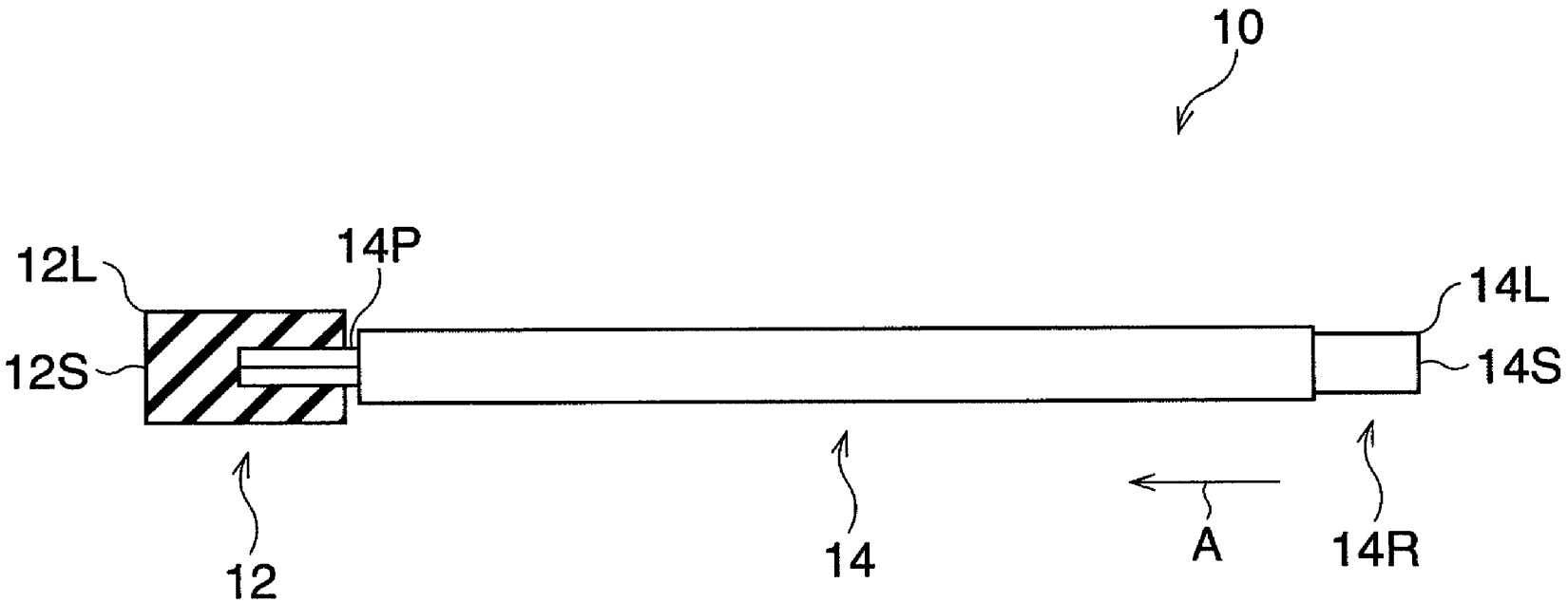
FIG. 5 is a section view of the cleaning tool of the first embodiment, where the adhesive member is attached.

As is clear from the above explanation, when the adhesive member 12 is attached to the body 14 (see FIG. 5), movement of the adhesive member 12 relative to the body 14, can be prevented. Note that FIG. 5 is a section view taken along a plane parallel to the longitudinal direction of the body 14. On the adhesive member 12, an adhesion-side-projection 12P projecting from the surface of the fitting hole 12H is provided (see FIG. 4B for a section view), to prevent the adhesive member 12 becoming detached from the body 14 easily. In FIG. 5, the adhesion-side-projection 12P is omitted.

Figure 6:
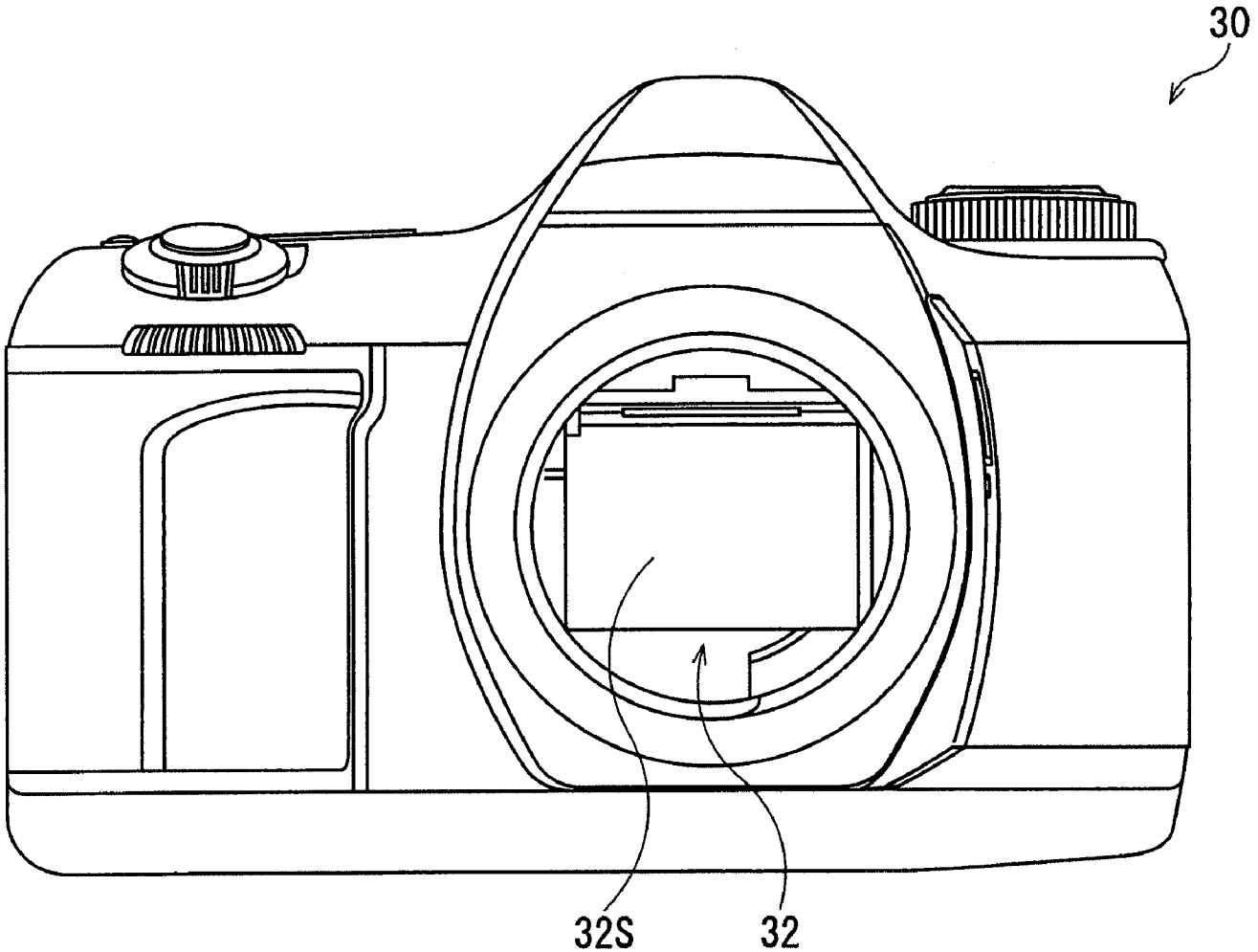
FIG. 6 is a front view of a digital single-lens reflex camera that is to be cleaned by the cleaning tool.

As an example, the cleaning tool 10 is used for cleaning a low-pass filter (hereinafter named LPF) 32 provided in the imaging device unit of the digital single-lens reflex camera 30 (a photographic device, see FIG. 6). In this case, the surface 32S of the LPF 32 to be cleaned has a rectangular shape, so the rectangular area 12R of the adhesive surface 12S can be used for cleaning around the surface 32S of the LPF 32.

On the other hand, for example, when a view finder (not shown) that has a round shape and that is provided in the digital single-lens reflex camera 30 is cleaned, the arcuate area 12C of the adhesive surface 12S can be mainly used. As explained above, by selecting the area of the adhesive surface 12S according to the shape of a surface to be cleaned, effective cleaning operations are possible. Further, even when the surface to be cleaned, such as the surface 32S of the LPF 32, is in a dark place, the orientation of the adhesive member 12 can be easily judged by a user holding the pillar-shaped section 14R of the body 14, by observing the pillar-shaped section 14R, and especially the rear end surface 14S.

In the first embodiment explained above, the cleaning tool 10 has superior operationality, and can efficiently clean various members having different shapes provided in the digital single-lens reflex camera 30, by utilizing the adhesive surface 12S that includes the arcuate area 12C, the rectangular area 12R, and an outline having a shape other than round; and by representing the shape and orientation of the adhesive surface 12S on the rear end surface 14S. Further, detachment of the adhesive member 12 from the body 14 is prevented by the adhesion-side-projection 12P, and even if detached from the body 14, the adhesive member 12 is easily re-attached to the body 14 in an orientation suitable for cleaning operation due to the fact that the shapes of the fitting hole 12H and the body-side-projection 14P correspond to each other.

Figures 7A, 7B:
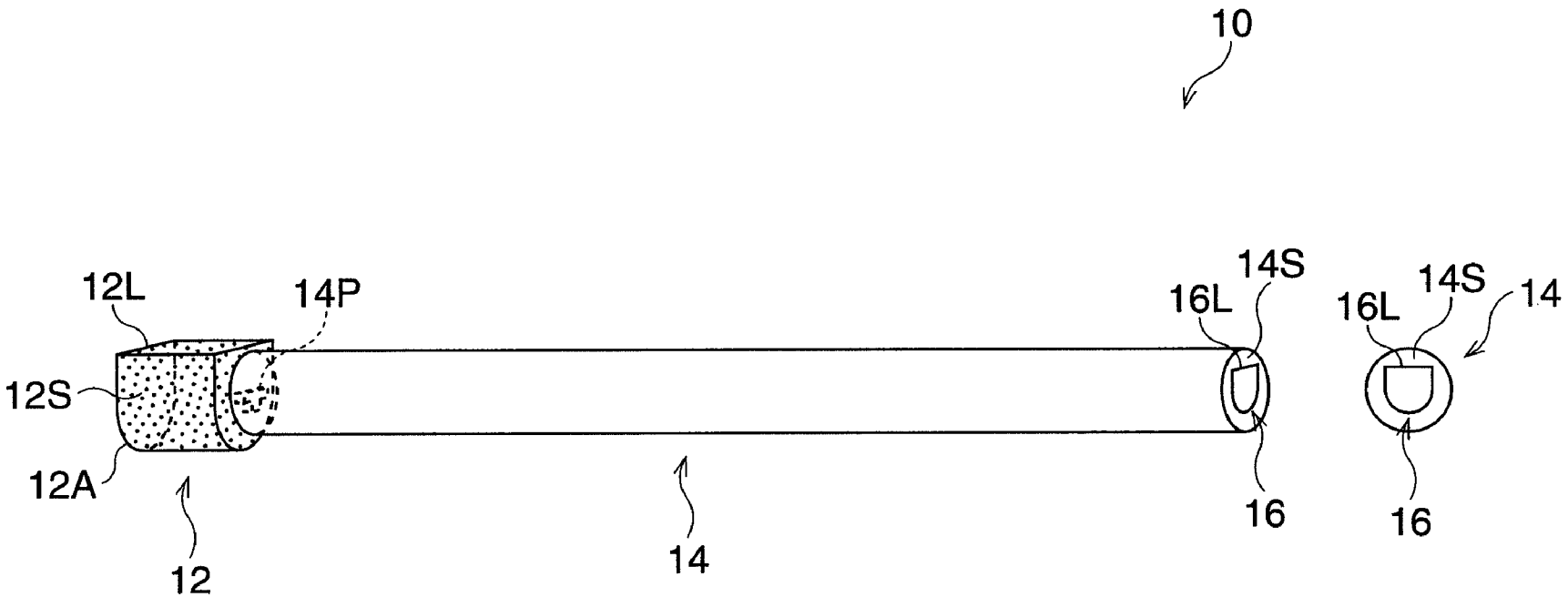
FIG. 7A is a perspective view of the cleaning tool of the first embodiment, where a section of the body has been altered.
FIG. 7B is a rear view of the cleaning tool of the first embodiment, where a section of the body has been altered.
Figure 8B:
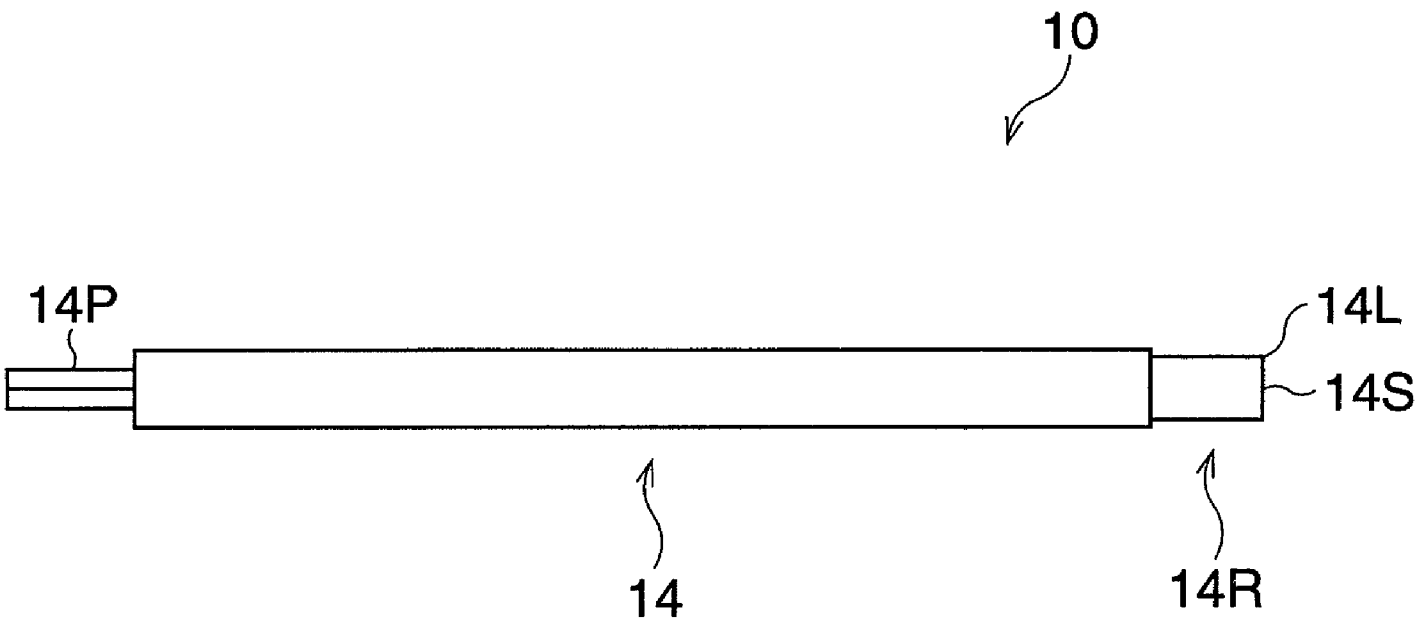
FIG. 8B is a side view of the body of the cleaning tool of the second embodiment, where the adhesive member is detached.
Figure 8A:
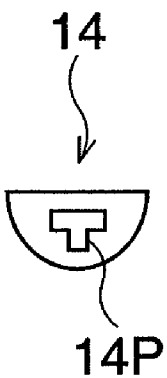
FIG. 8A is a front view of the body of the second embodiment, where the adhesive member is detached.

The shape and orientation of the adhesive member 12, the body 14 and other members are not limited to those explained above. For example, although it is preferable to provide the pillar-shaped section 14R to clearly represent the shape and orientation of the adhesive surface 12S, only a mark 16 that represents the shape and orientation of the adhesive surface 12S, may be provided on the rear end surface 14S, without the pillar-shaped section 14R (see FIGS. 7A and 7B). In this case, the orientation of the adhesive surface 12S is represented, for example, by providing the mark 16 having a straight line 16L parallel to the straight line 12L of the adhesive surface 12S. In this variational example, the structure of the body 14 can be simplified by providing the mark 16 instead of the pillar-shaped section 14R.

Further, when the adhesive surface 12S is in contact with a surface to be cleaned; for example, the surface of a rectangular imaging device, the adhesive surface 12S can be easily fitted along the edge of the surface. This is because that the shapes of the adhesive surface 12S and the rear end surface 14S are similar to each other, and the outlines of both of the adhesive surface 12S, and the rear end surface 14S, include the straight line 12L and the straight line 14L, respectively.

Next, the second and third embodiments are explained, referring to FIGS. 8A to 11B. Note that in the figures following FIG. 8A, components of the cleaning tool 10 which are the same as or correspond to those in the first embodiment, have the same reference numerals. In the second and third embodiments, the shapes of the adhesive member 12 are different from that of the first embodiment. That is, the adhesive surfaces 12S in the second and third embodiments include arcuate areas of which part of the outline is arcuate (arcuate sections 12A), and which do not include a rectangular area having a rectangular shape (see FIGS. 9A and 11A). However, both the adhesive surfaces 12S in the second and third embodiments include straight lines 12L (linear sections) in their outlines.

Figure 9B:
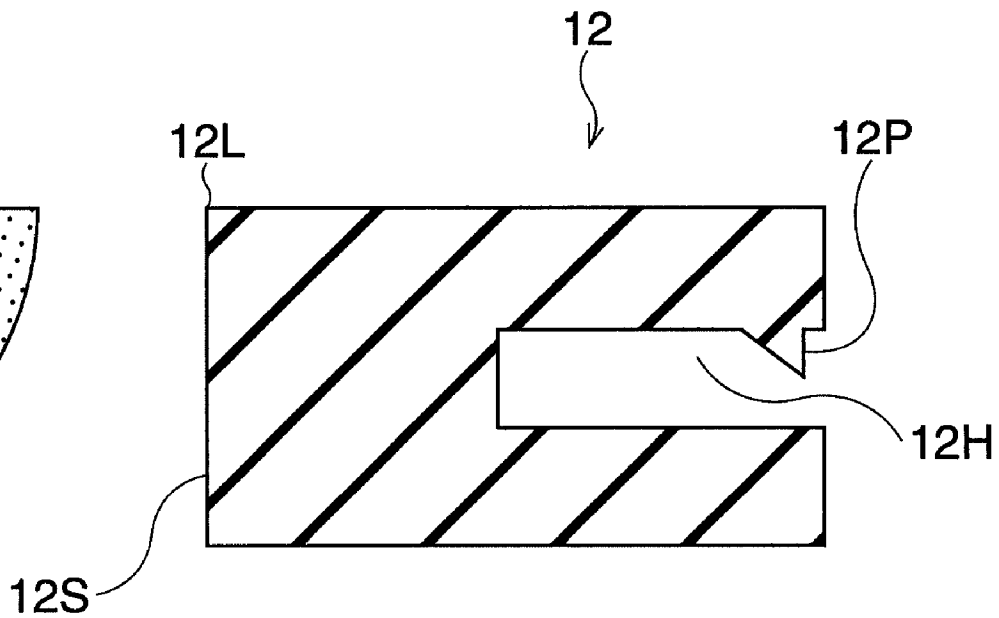
FIG. 9B is a sectional view of the adhesive member of the second embodiment.
Figure 9A:
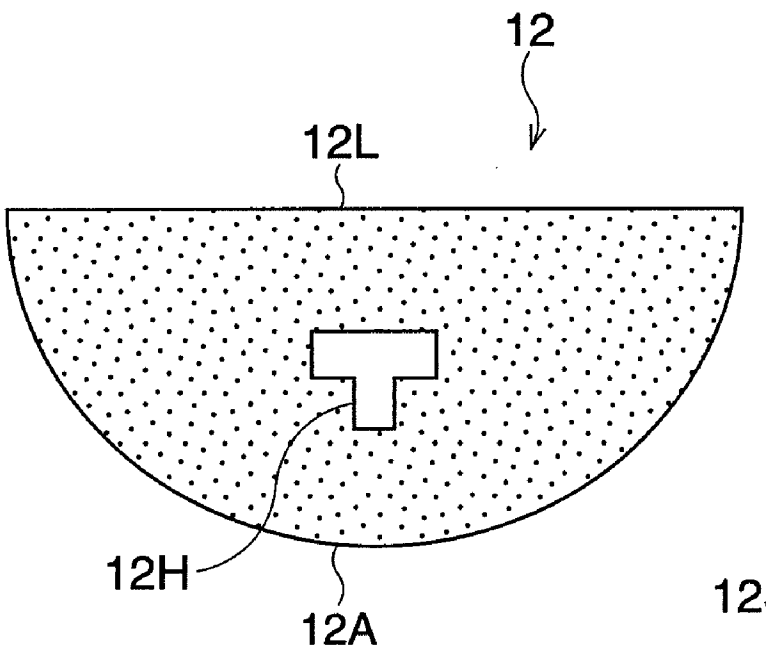
FIG. 9A is a rear view of the adhesive member of the second embodiment.
Figure 10B:
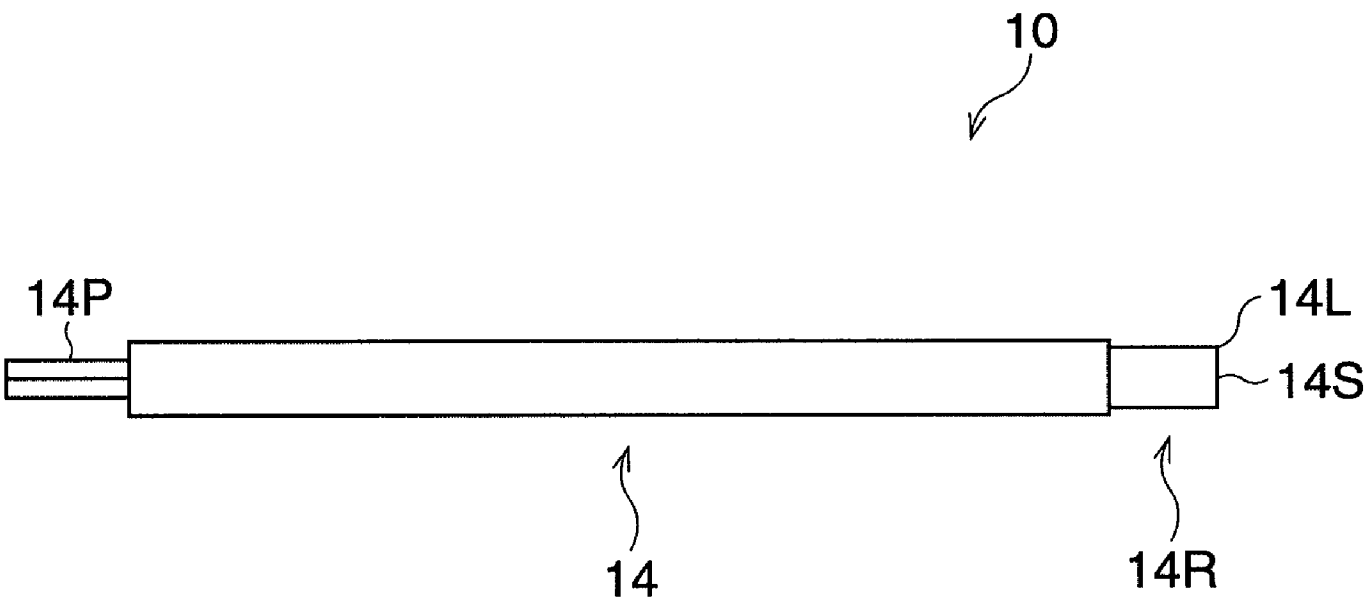
FIG. 10B is a side view of the body of the cleaning tool of the third embodiment, where the adhesive member is detached.
Figure 10A:
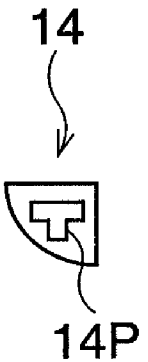
FIG. 10A is a front view of the body of the third embodiment, where the adhesive member is detached.
Figure 11B:
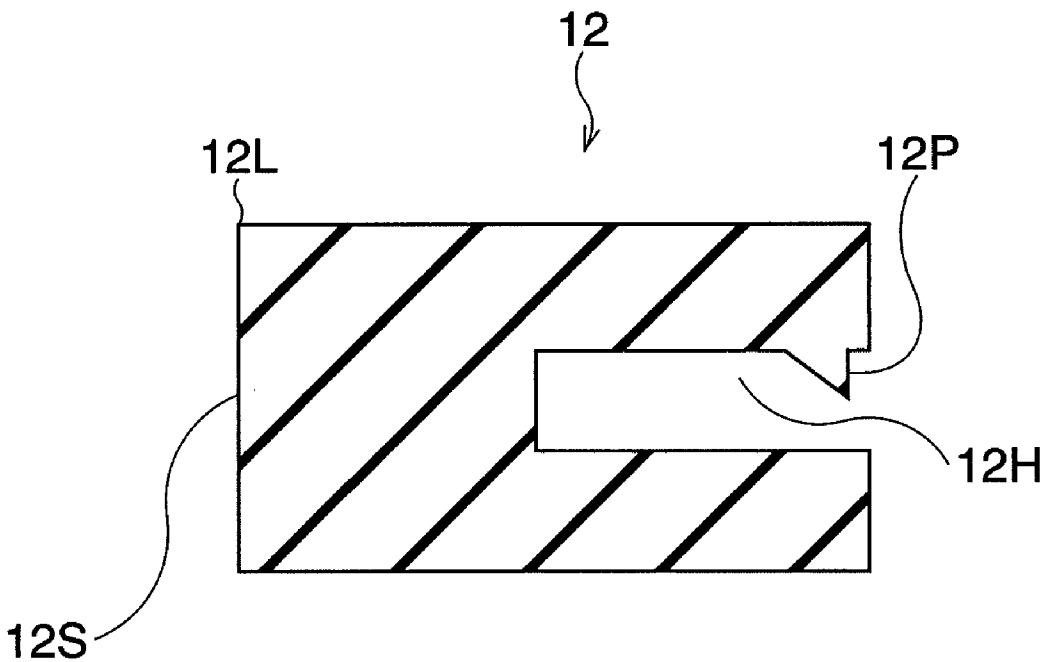
FIG. 11B is a sectional view of the adhesive member of the third embodiment.
Figure 11A:
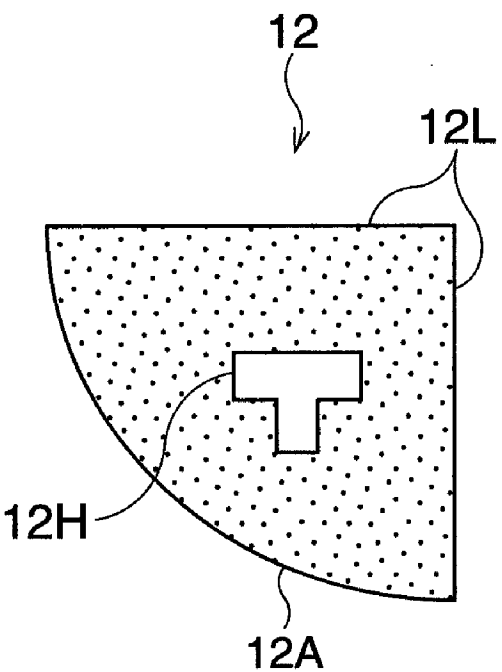
FIG. 11A is a rear view of the adhesive member of the third embodiment.
Figure 12B:
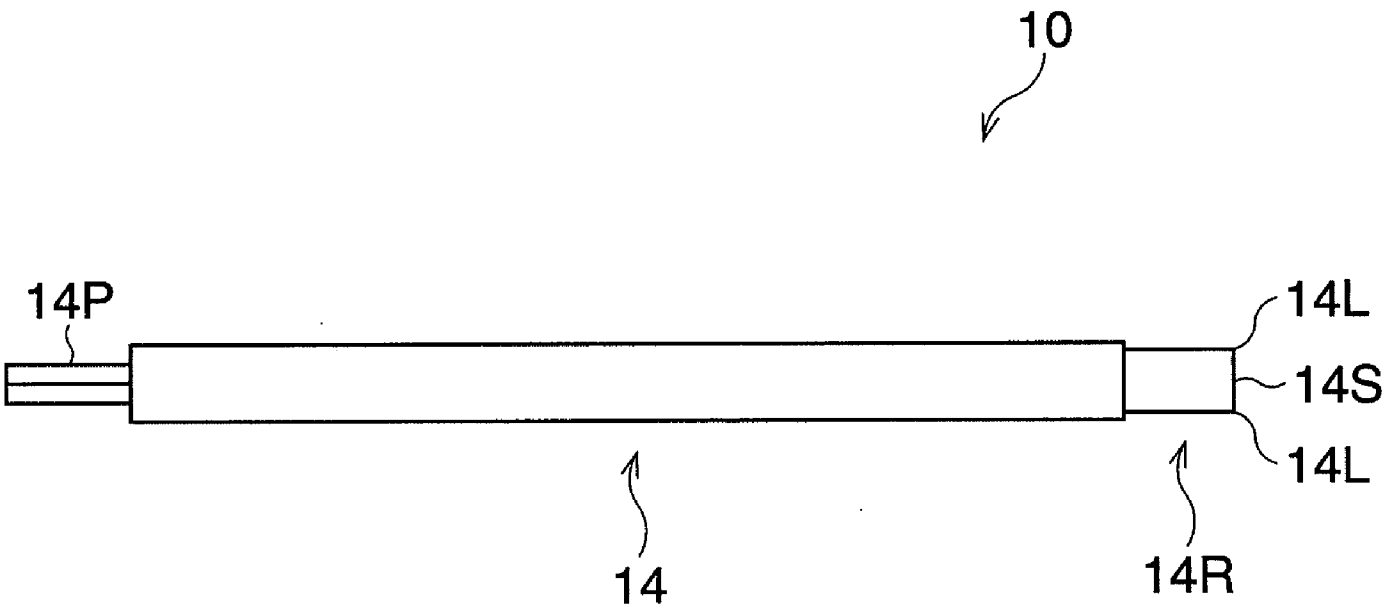
FIG. 12B is a side view of the body of the cleaning tool of the fourth embodiment, where the adhesive member is detached.
Figure 12A:
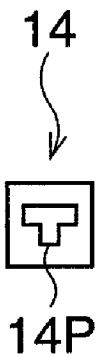
FIG. 12A is a front view of the body of the fourth embodiment, where the adhesive member is detached.
Figure 13B:
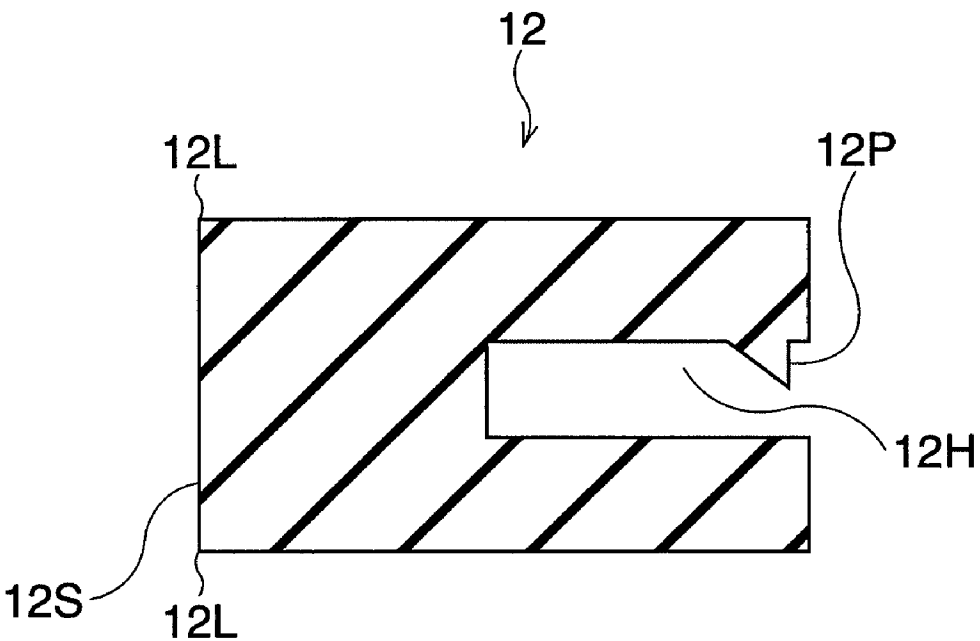
FIG. 13B is a sectional view of the adhesive member of the fourth embodiment.
Figure 13A:
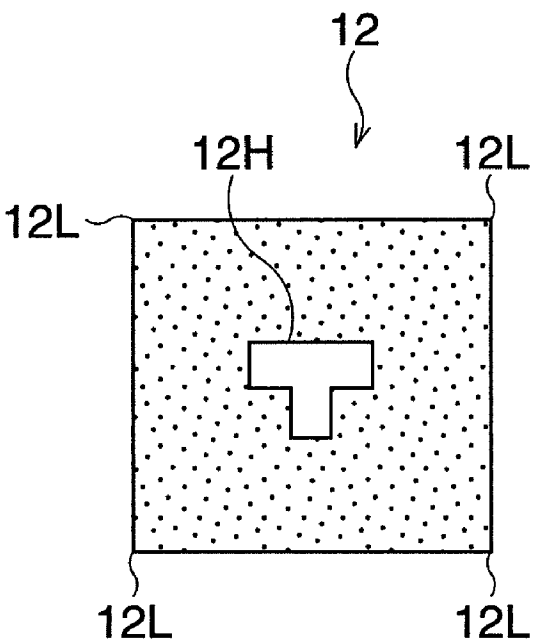
FIG. 13A is a rear view of the adhesive member of the fourth embodiment.
Figure 14B:
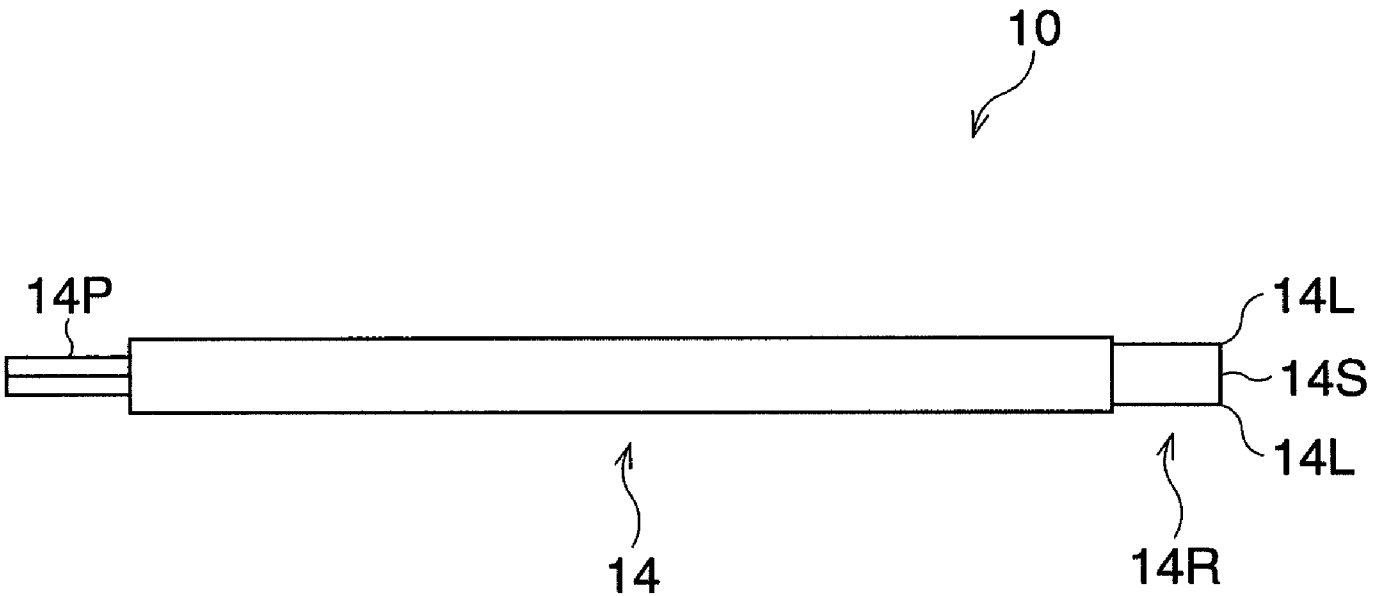
FIG. 14B is a side view of the body of the cleaning tool of the fifth embodiment, where the adhesive member is detached.
Figure 14A:
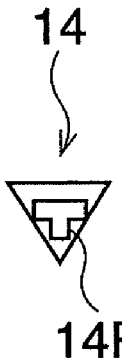
FIG. 14A is a front view of the body of the fifth embodiment, where the adhesive member is detached.
Figure 15B:
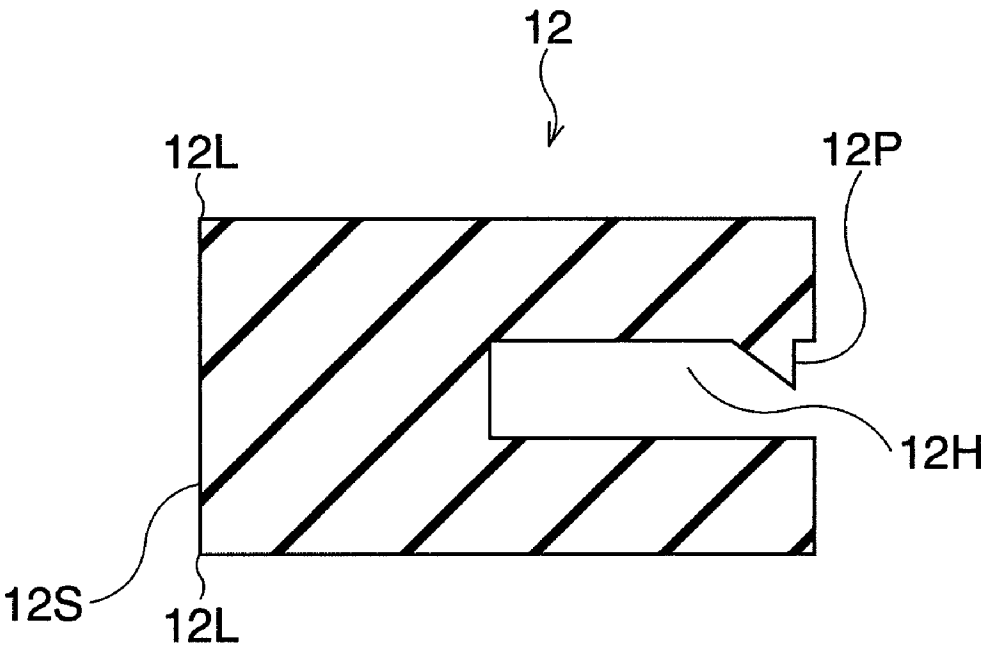
FIG. 15B is a sectional view of the adhesive member of the fifth embodiment.
Figure 15A:
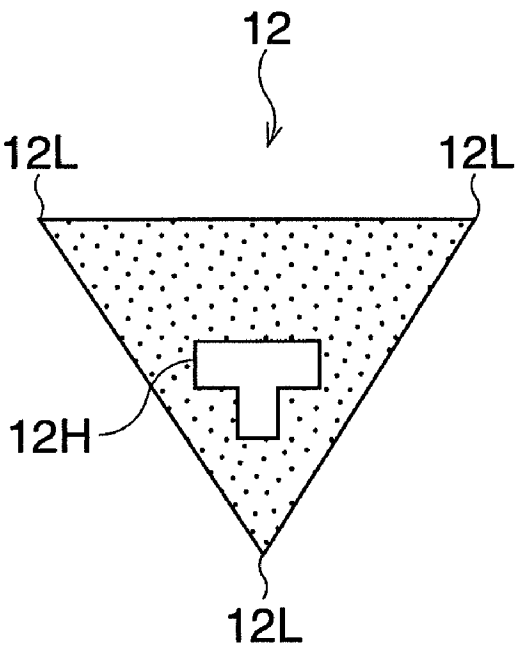
FIG. 15A is a rear view of the adhesive member of the fifth embodiment.
Figure 16B:
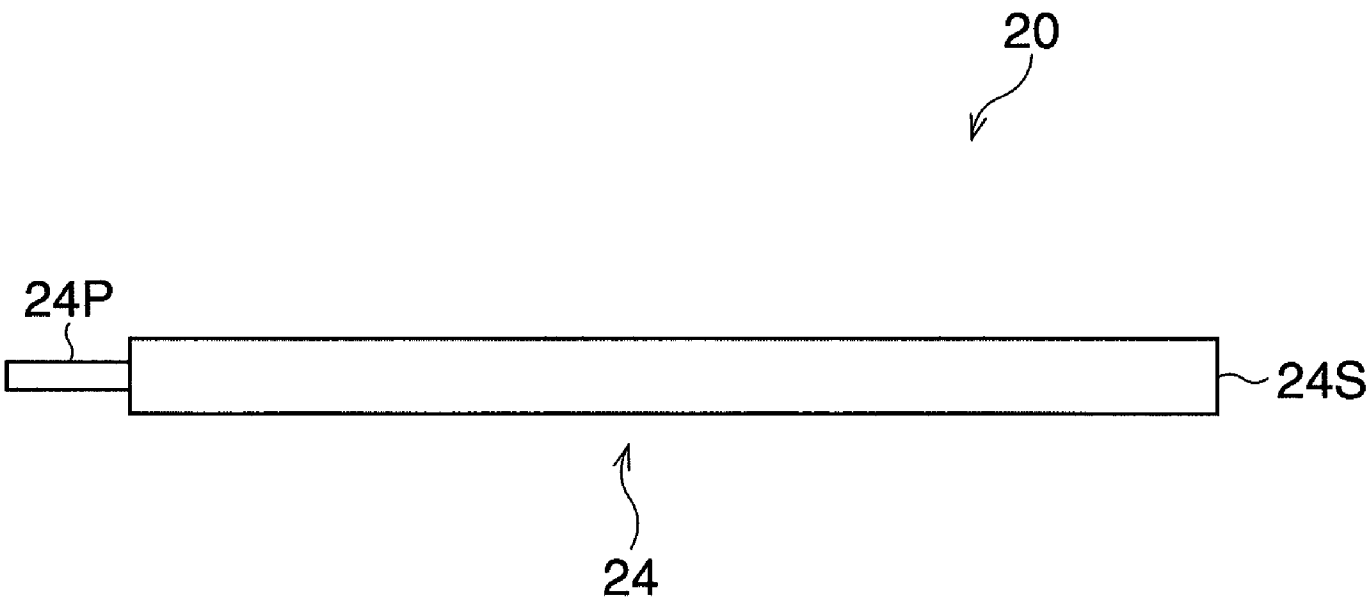
FIG. 16B is a side view of the body of a comparative example, where the adhesive member is detached.
Figure 16A:
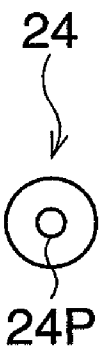
FIG. 16A is a front view of the body of a comparative example, where the adhesive member is detached.
Figure 17B:
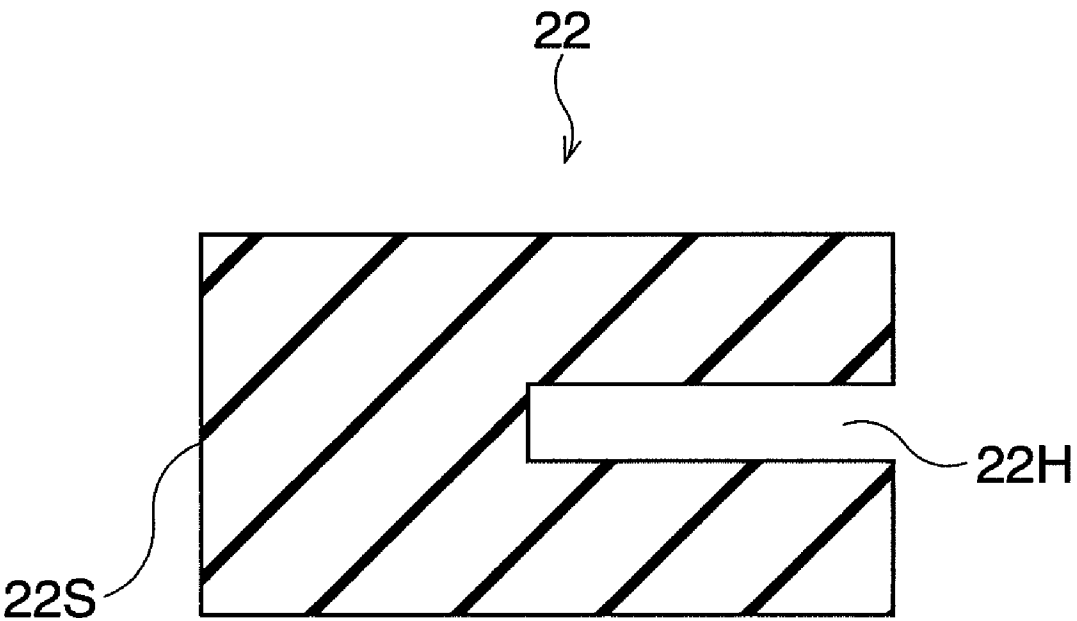
FIG. 17B is a sectional view of the adhesive member of a comparative example.
Figure 17A:
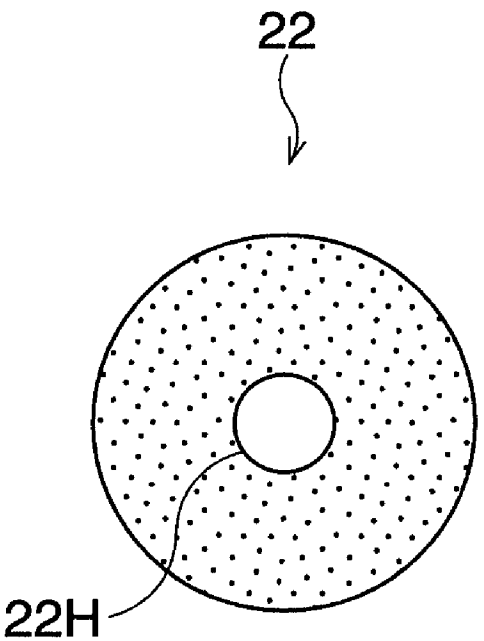
FIG. 17A is a rear view of the adhesive member of a comparative example.

As explained above, in the second and third embodiments, a part of the outline of the adhesive surfaces 12S is a linear section, that is, the adhesive surfaces 12S include an area in the vicinity of the straight lines 12L (see FIGS. 9A and 11A). Therefore, in these second and third embodiments, as well as the first embodiment, not only a surface having a round shape, but also a surface having a rectangular shape such as the surface 32S of the LPF 32 can be effectively cleaned by the cleaning tool 10.

Further, in these embodiments, the sectional shape of the pillar-shaped section 14R taken along a plane which is perpendicular to the longitudinal direction of the body 14, is a similar figure of the adhesive surface 12S, and the straight line 14L that is a part of the outline of the rear end surface 14S, and the straight line 12L that is a part of the outline of the adhesive surface 12S, are parallel to each other. That is, as in the first embodiment, the shape and orientation of the adhesive surface 12S is represented on the rear end of the body 14. Further, the sectional shapes of the fitting hole 12H and body-side-projection 14P are both T-shape (see FIGS. 8A for a front view, 9A for a rear view, 10A for a front view, and 11A for a rear view), so that shifting the position of the adhesive member 12 as attached to the body 14, can be prevented as in the first embodiment.

Also, in the second and third embodiments, as explained above, it is possible to adjust the orientation of the adhesive surface 12S according to the shape of a surface to be cleaned during a cleaning operation. Therefore, even when the cleaning tool 10 is used for cleaning the surface 32S of the LPF 32, or other surfaces located in a dark place, the cleaning tool 10 has superior operability.

Next, the fourth and fifth embodiments are explained referring to FIGS. 12A to 15B. In the fourth and fifth embodiments, the shapes of the adhesive member 12 are different from those in the former embodiments. That is, the outlines of the adhesive surfaces 12S do not include an arcuate section, and the adhesive surfaces 12S do not include arcuate areas. That is, the outlines of the adhesive surfaces 12S are formed only by straight lines.

Therefore, although the cleaning tool 10 in the fourth and fifth embodiments is not as suitable as that of the former embodiments for cleaning a surface having a round outline, it is suitable for cleaning a surface having a rectangular shape, such as the surface 32S of the LPF 32 which tends to be the most likely to suffer problems from foreign matter adhesion in the digital single-lens reflex camera 30, and which has a high need of cleaning.

Further, also in the fourth and fifth embodiments, the shape of the section of the pillar-shaped section 14R is a similar figure of the adhesive surface 12S, and the straight line 14L included in the outline of the rear end surface 14S and the straight line 12L included in the outline of the adhesive surface 12S, which correspond to each other, are parallel. That is, as in the former embodiments, the shape and orientation of the adhesive surface 12S is represented at the rear end of the body 14. Further, also in the fourth and fifth embodiments, the sectional shapes of the fitting hole 12H and body-side-projection 14P are both T-shape (see FIGS. 12A for a front view, 13A for a rear view, 14A for a front view, and 15A for a rear view) so that shifting the position of the adhesive member 12 as attached to the body 14 can be prevented.

In the fourth and fifth embodiments, as explained above, efficiently cleaning a surface, especially one which has a rectangular shape, is possible, and the orientation of the adhesive surface 12S can be easily adjusted even when the location of the surface to be cleaned is dark.

Figure 18:
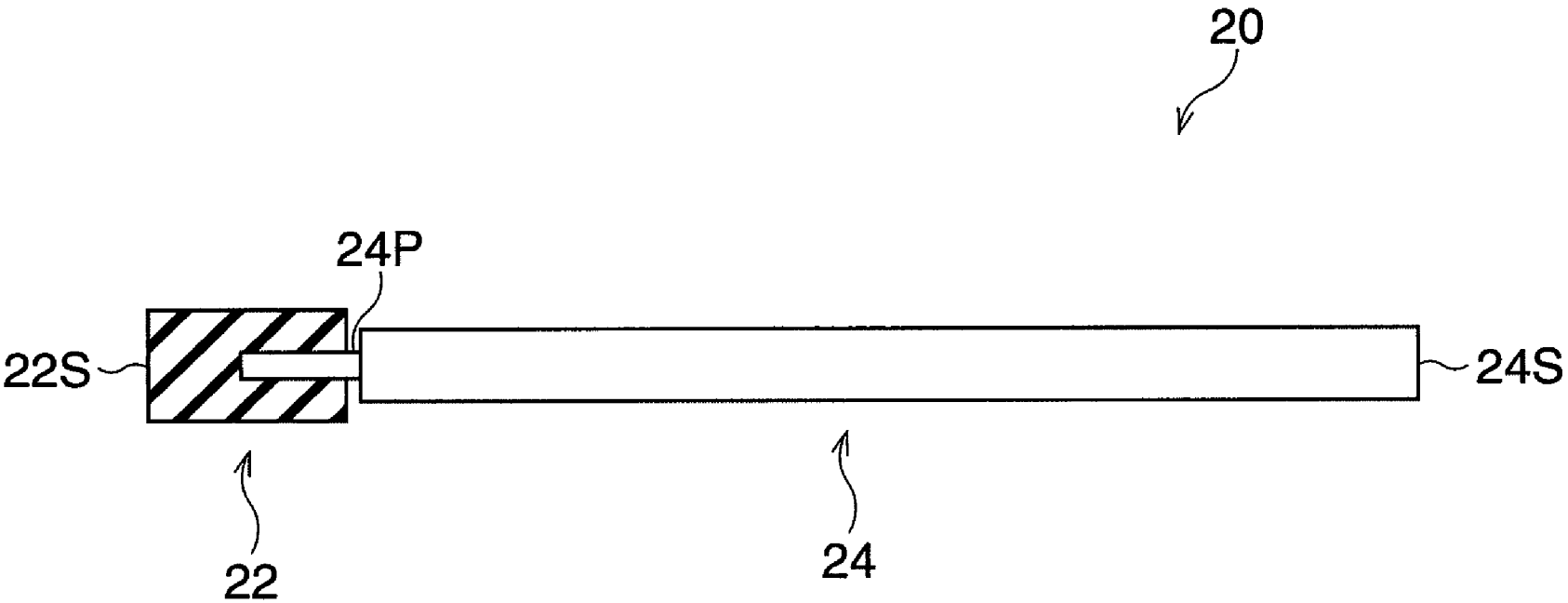
FIG. 18 is a section view of the cleaning tool of the comparative example, where the adhesive member is attached.

Next, a comparative example of the cleaning tool 20 is explained by referring to FIGS. 16A to 18. Note that FIG. 18 is a section view taken along a plane parallel to the longitudinal direction of the body 24. In the cleaning tool 20 of the comparative example, a column shaped adhesive member 22 is attached to the body 24; thus, the adhesive surface 22S has a round shape (see FIG. 17A). Therefore, when the cleaning tool 20 is used for cleaning a rectangular shaped surface such as the surface 32S of the LPF 32, the operations of removing foreign matter from the surface is difficult when compared to the cleaning tool 10 in the embodiments explained above.

In the comparative example, no mark is provided on the rear end surface 24S nor the pillar-shaped section, thus differing from the first embodiment. This is because the adhesive surface 22S has a circular shape, so a change in the orientation thereof is unnoticeable. Further, the sectional shapes of the fitting hole 22H and body-side-projection 24P are both circular (see FIGS. 16A for a front view and 17A for a rear view); because when the adhesive member 22 rotates about an axis parallel to the direction in which the body 24 extends, the relative rotational position of the adhesive member 22 to the body 24 is not changed, so preventing a position shift, as in the previous embodiments, has no benefit.

Note that the shapes of the adhesive member 12, body 14 and other members, are not limited to those in the aforementioned embodiments. For example, as well as the first embodiment, the mark 16 may be provided on the rear end surface 14S without the presence of the pillar-shaped section 14R (see FIGS. 7A and 7B) to represent the orientation of the adhesive surface 12S in other embodiments. Further, only the orientation, without the outline, of the adhesive surface 12S may be represented on the rear end surface 14S. For example, providing the mark 16 as an arrow that represents the location of the arcuate area 12C in the adhesive surface 12S, on the rear end surface 14S, may be enough for a user who previously knows the shape of the adhesive surface 12S to operate the cleaning tool 10 efficiently.

Further, in terms of the shapes of the fitting hole 12H and body-side-projection 14P, they are not limited to the T-shape of the aforementioned embodiments, as long as the shape of the fitting hole 12H and body-side-projection 14P enable the adhesive member 12 to be attached to the body 14 only when the adhesive member 12 and the body 14 are in a predetermined relative position, and prevents the shift of the rotational position of the adhesive member 12 and the body 14 after the attachment. For example, the sectional shapes of the fitting hole 12H and body-side-projection 14P may be one of a trapezoid, a quadrangle whose four sides have different length each other, an isosceles triangle, or a triangle whose three sides have different lengths to each other. Further, a plurality of fitting holes 12H and body-side-projections 14P may be provided to easily determine the attachment position of the adhesive member 12 to the body 14.

In the adhesive surface 12S, the arcuate area 12C may have a semicircle shape, a sector shape whose center angle is smaller than that of a quadrant, a part of an oval arc shape, or so on. The rectangular area 12R may have a square shape, a quadrangular shape which has two sides orthogonal to each other, or so on. Further, in the adhesive surface 12S, a side of the rectangular area 12R may be coincident with only a part of the linear section of the outline of the arcuate area 12C. Note that not only the shapes but also the materials of the cleaning tool 10 are not limited to those in the embodiments. For example, the adhesive member 12 may be formed by a urethane type resin having adhesiveness, a styrene type resin, or so on, in addition to the butyl rubber described.

Finally, it will be understood by those skilled in the art that the foregoing description is of preferred embodiments of the apparatus, and that various changes and modifications may be made to the present invention without departing from the spirit and scope thereof.

The present disclosure relates to subject matters contained in Japanese Patent Application No. 2006-193953 (filed on Jul. 14, 2006), which is expressly incorporated herein, by reference, in its entirety.

The invention claimed is:

1. A cleaning tool to remove foreign matter from a surface of a photographic device, said cleaning tool comprising:

an adhesive member that has an adhesive surface for said foreign matter to adhere, said adhesive surface comprising an arcuate area and a rectangular area, a part of the perimeter of the arcuate area being curved, and the rectangular area having a rectangular perimeter, the perimeter of said arcuate area further comprising a linear section, and said linear section is coincident with a side of the perimeter of said rectangular area; and a body that has a first end to which said adhesive member is attached and that has an end surface located at a second end that is opposite to said first end, a shape and orientation of said adhesive surface being indicated on said end surface, said adhesive surface extends in a plane perpendicular to the direction in which said body extends between said first and second ends, the shape of said end surface is similar to the shape of said adhesive surface, and an orientation of said end surface is the same as an orientation of said adhesive surface.

2. The cleaning tool according to claim 1, wherein said arcuate area has a semicircular shape.

3. The cleaning tool according to claim 1, wherein said body comprises a pillar-shaped member having a bottom surface that comprises said end surface.

4. The cleaning tool according to claim 1, wherein said adhesive member has a fitting hole, and said body comprises a projection configured to fit into said fitting hole, such that said projection can be fit into said fitting hole and said adhesive member can be attached to said body only when said adhesive surface is oriented in the same orientation as indicated on said end surface.

5. A cleaning tool to remove foreign matter from a surface of a device, said cleaning tool comprising:

an adhesive member that has an adhesive surface for said foreign matter to adhere, said adhesive surface comprising an arcuate area and a rectangular area, a part of the perimeter of the arcuate area being curved, and the rectangular area having a rectangular perimeter, the perimeter of said arcuate area further comprising a linear section, and said linear section is coincident with a side of the perimeter of said rectangular area;

a body that has a first end to which said adhesive member is attached and that has an end surface located at a second end that is opposite to said first end, a mark on said end surface indicating a shape and orientation of said adhesive surface, said adhesive surface extending in a plane perpendicular to the direction in which said body extends between said first and second end.

6. The cleaning tool according to claim 5, wherein said arcuate area has a semicircular shape.

7. The cleaning tool according to claim 5, wherein said body comprises a pillar-shaped member having a bottom surface that comprises said end surface.

8. The cleaning tool according to claim 5, wherein said adhesive member has a fitting hole, and said body comprises a projection configured to fit into said fitting hole, such that said projection can be fit into said fitting hole and said adhesive member can be attached to said body only when said adhesive surface is oriented in the same orientation as the mark on said end surface.

9. The cleaning tool according to claim 5, said mark having a shape and an orientation corresponding to the shape and orientation of said adhesive surface.

10. The cleaning tool according to claim 1, said adhesive surface comprising butyl rubber.

11. The cleaning tool according to claim 5, said adhesive surface comprising butyl rubber.

12. A cleaning tool that removes foreign matter from a surface of a device, said cleaning tool comprising:

an adhesive member having an adhesive surface to which foreign matter adheres;

an elongated member having first and second longitudinal ends and configured to have said adhesive member attached to the first longitudinal end;

said adhesive surface comprising a planar surface extending in a plane perpendicular to the longitudinal direction of said elongated member, said adhesive surface being defined by a periphery that includes at least one arcuate peripheral portion and a least one linear peripheral portion; and an indicator that indicates an orientation of said at least one arcuate peripheral surface and said at least one linear peripheral surface, said indicator being provided on said second longitudinal end of said elongated member.

13. The cleaning tool according to claim 12, said indicator comprising a mark on said second longitudinal end of said elongated member that has a shape and an orientation corresponding to a shape and orientation of said adhesive surface.

14. The cleaning tool according to claim 12, said indicator comprising a shape and an orientation of said second longitudinal end of said elongated member that correspond to a shape and an orientation of said adhesive surface.

15. The cleaning tool according to claim 12, said at least one arcuate peripheral surface comprising a semicircle and said at least one linear peripheral portion corresponding to a diameter of said semicircle.

16. The cleaning tool according to claim 12, said a least one arcuate peripheral surface comprising a semicircle said adhesive surface further comprising a rectangular area, a peripheral surface of said rectangular area comprising said a least one linear peripheral portion, a surface of said rectangular area opposite to and parallel to said linear peripheral portion being coincident with a diameter of said semicircle.

17. The cleaning tool according to claim 12, said at least one arcuate peripheral surface comprising a quadrant, said at least one linear peripheral portion comprising two linear surfaces extending perpendicular to each other and defining said quadrant.

18. The cleaning tool according to claim 12, one of said adhesive member and said elongated member comprising a fitting hole, the other of said adhesive member and said elongated member comprising a projection configured to be received within said fitting hole, said fitting hole and said projection being configured such that said projection can be received in said fitting hole and said adhesive member can be attached to said elongated member only when said adhesive surface is oriented in a same orientation as indicated on said end surface, by said indicator.

19. The cleaning tool according to claim 12, said adhesive surface comprising butyl rubber.

* * * * *